United States Patent [19]

Wright

[11] 4,032,066

[45] June 28, 1977

[54] ADAPTERS FOR CENTRIFUGE ROTORS

[75] Inventor: Herschel Eugene Wright, Santa Clara, Calif.

[73] Assignee: Beckman Instruments, Inc., Fullerton, Calif.

[22] Filed: Mar. 15, 1976

[21] Appl. No.: 666,987

[52] U.S. Cl. ..... 233/26; 211/74; 220/17; 206/499

[51] Int. Cl.² ..... B04B 5/02

[58] Field of Search ..... 233/26, 1 R; 211/74; 220/17; 206/499, 500, 521

[56] References Cited

UNITED STATES PATENTS

| | | | |
|---|---|---|---|
| 2,110,308 | 3/1938 | Nelson | 233/26 X |
| 3,674,198 | 7/1972 | Sberle | 211/74 X |
| 3,830,425 | 8/1974 | Stallmann | 233/26 |

*Primary Examiner*—George H. Krizmanich

*Attorney, Agent, or Firm*—R. J. Steinmeyer; F. L. Mehlhoff; W. H. May

[57] ABSTRACT

An adjustable supporting arrangement used within the sample receiving cavity of a centrifuge rotor to hold and align a plurality of test tubes. The arragement is comprised of a series of similarly configured interface layers which can be variably arranged to accommodate different sized test tubes. A bracket member is utilized to retain the alignment of the various interface layers and hold them as a single unit for convenient movement into and out of the rotor cavity. Incorporated within the supporting arrangement is a separate cushion pad to receive the bottom ends of the test tubes. A uniquely designed divider plate can be placed within the supporting arrangement to partition the rotor cavity into two areas for receipt of two sets of test tubes in stacked relation.

14 Claims, 10 Drawing Figures

ADAPTERS FOR CENTRIFUGE ROTORS

BACKGROUND OF THE INVENTION

The present invention is related to centrifuge rotors and, more particularly, to test tube adapters to convert a single sample receiving cavity in the rotor to a multi-cavity configuration for receipt of a plurality of test tubes.

In the design of many presently used centrifuge rotors, such a swing bucket type rotor, the cavity for receiving the test sample is designed to be large to accommodate a large amount of the sample to be tested. However, at times it is desirable to utilize the same rotor to centrifuge smaller amounts of test samples in smaller cavities such as test tubes. Therefore, some type of an adapter is necessary to reduce the size of the rotor cavity to accommodate test tubes which can be located within the same large cavity. Typically the adapters which are currently utilized have a cylindrical configuration with an outer diameter substantially the same as the inner diameter of a rotor cavity. Within the adapter are a series of small diameter cavities or apertures for receipt of the test tubes carrying the various samples to be centrifuged. One end of the adapter is closed so that the bottoms of the test tubes rest within the adapter. In most instances the adapters have one specified depth. This becomes a problem when the adapter is a shorter depth than the test tubes, because the test tubes will not receive sufficient support during centrifugation. On the other hand, if the test tubes are shorter than the adapter, placement and removal of the test tubes within the adapter cavities is difficult. Further, when the adapter is shorter than the depth of the rotor cavity, as is typically the case, it is impossible to conveniently remove the adapter with the test tubes as a unit from the rotor, requiring the separate and tedious removal of each individual test tube from the rotor.

Typically the most economical way to produce the adapters is through injection molding. However, a significant disadvantage occurs with the utilization of injection molding when the adapter is of a significant depth, because the molding machine mold, carrying the core pins, requires a certain draft angle in order to allow the removal of the core pins subsequent to the injection molding process. Since a certain minimum diameter for each of the test tube cavities must be present throughout the depth of the adapter, a sizable difference can accumulate between the minimum diameter of the test tube cavity at the bottom of the adapter and the diameter of the cavity at the open or upper end of the adapter. The accumulation of the draft angle can be significant enough to sacrifice the necessary support around the test tube or force a decrease in the number of cavities in a given diameter adapter. When such draft angle accumulation is not tolerable, the user in many instances is forced to custom drill the test tube cavities from a solid cylindrical member to provide a more uniform test tube cavity throughout the depth of the adapter. This becomes very expensive when producing several adapters because of the drilling work.

A further problem related to the injection molding of adapters of a significant depth is related to the drift which occurs in some cases with core pins in the mandrel resulting in some of the test tube cavities being improperly spaced and not having sufficient spacing between each other to establish a satisfactory wall between the tube cavities.

Another inherent disadvantage to the presently used adapters relates to the bottom support for the test tube within the adapter. Since the adapter is typically made of a rigid material and has a closed bottom, it is necessary to put some type of cushioning material in the bottom of each of the test tube cavities. Such approach presently uses the tedious method of inserting a cushioning pad at the bottom of each of the test tube cavities to provide the necessary support of the test tube. However, during centrifugation, the cushioning pads do not provide the necessary support, resulting in the test tube having a single point of contact with the bottom hard surface of the adapter. This lessens the maximum load which the test tube can withstand during centrifugation.

SUMMARY OF THE INVENTION

The present invention comprises a variable arrangement of a series of interface layers each having substantially the same configuration and capable of being adjustable in conjunction with each other to accommodate various sized test tubes for placement within a large rotor cavity. The interface layers or adapter sections are maintained in stacked alignment with each other and held together to form a single unit by a bracket member which also provides a convenient means for removing the interface layers with the test tubes from the rotor cavity. The use of separate similarly configured interface layers allows for variable stacking of the layers to provide an adjustable support adapter unit which can be arranged in such a manner to be approximately the same depth as any of a number of various sized test tubes.

The relatively thin configuration of the interface layers permits acceptable construction of the layers by an injection molding process where the draft angle accumulation throughout a series of stacked layers is limited to the accumulation of the draft that occurs in just one layer. Consequently, there is adequate support throughout the depth or length of the test tube, since no significant gap is present between the test tubes and the cavities of the interface layers.

Incorporated within the present invention is the use of a specifically designed cushion pad for placement in the bottom of the rotor cavity on which the bottoms of the test tubes rest. The cushion pad is constructed of a resilient material which receives the bottom of the test tubes and forms, during centrifugation, a supporting cup which is in compliance with the overall bottom surface configuration of the test tube to provide a larger load distributing support surface. Therefore, elimination of a single point of contact between the test tube bottom and the support surface increases the maximum r.p.m. and load tolerance of the test tube.

In some instances the rotor cavity is of sufficient depth to accommodate at least two series of test tube samples. Therefore, a divider plate can be utilized to establish two separate compartments within the same rotor cavity to allow one series of test tubes to be placed above another series of test tubes. The divider plate is a lamination of two materials. One face of the plate comprises the same generally resilient cushioning material used in the base cushion pad to provide proper support for the bottoms of the test tubes in the upper portion of the rotor cavity. The second face of the divider plate is of a rigid material which covers the upper openings of the series of test tubes in the bottom of the rotor cavity.

The present invention provides an adjustable and versatile means for holding and supporting various sized test tubes within a rotor cavity. The similarly configured interface layers of this invention can be arranged to establish an adapter unit of the size required by the particular size of the test tubes used. The interface layers can be inexpensively made in such a manner that the test tube cavity tolerance is within acceptable limits to provide adequate support to the test tube. Regardless of the number of the stacked layers used, they can be conveniently removed from the rotor cavity as a single unit.

DETAILED DESCRIPTION OF THE INVENTION

Figure 1:
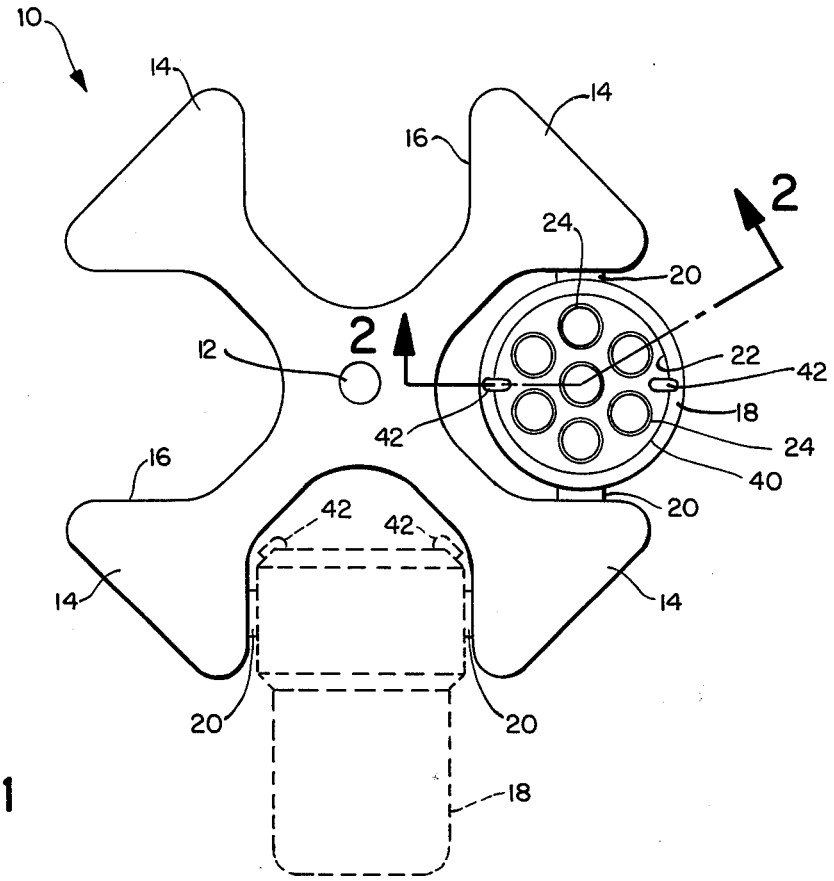
FIG. 1 is a top view of a bucket type rotor.

In FIG. 1 a swing bucket type rotor 10 is shown mounted on a rotational shaft 12. The rotor 10 has a series of spaced radially extending arms 14 which form a plurality of gaps 16 designed to receive rotor buckets 18. These buckets are mounted within the rotor arms 14 on pivot pins 20 which allow the buckets to pivot within the gaps 16. Therefore, when the rotor is at rest, the bucket will assume the orientation shown in solid lines while during the centrifugation operation the bucket 18 will swing to the position shown in phantom. The bucket 18 has a cylindrical configuration with an inner cylindrical cavity 22 which receives a plurality of test tubes 24 which hold the samples to be centrifugated.

Figure 2:
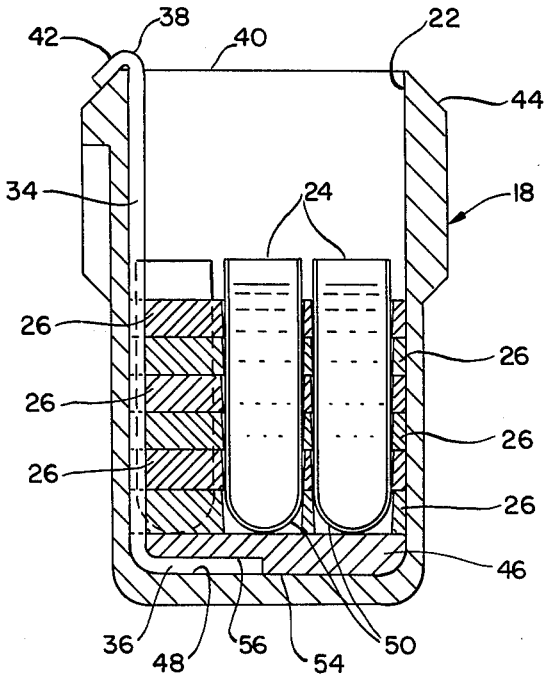
FIG. 2 is a sectional view taken along the lines 2—2 in FIG. 1.
Figure 3:
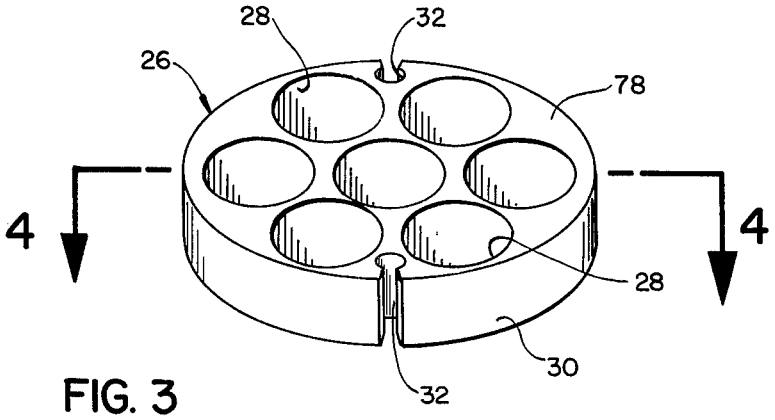
FIG. 3 is a perspective view of an adapter section.
Figure 4:
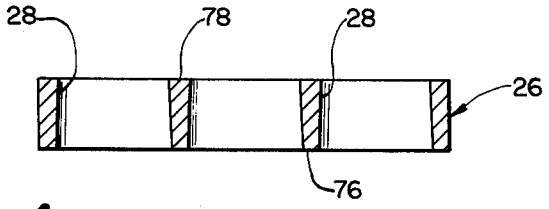
FIG. 4 is a sectional view taken along the lines 4—4 in FIG. 3.

The rotor bucket 18 is shown in more detail in FIG. 2 with the test tubes 24 supported within the rotor or bucket cavity 22 by a series of interface members or adapter sections 26. The configuration of each of the adapter sections 26 is shown in detail in FIG. 3 having a series of test tube cavities 28. Each adapter section 26 has a substantially cylindrical configuration with its outside diameter being substantially the same or slightly less than the interior diameter of the bucket cavity 22. The adapter section 26 is relatively thin with its diameter preferably being at least two to four times as large as its thickness. Located adjacent the outer cylindrical surface 30 of the adapter section 26 is a pair of recessed slots 32 approximately 180° from each other.

Figure 6:
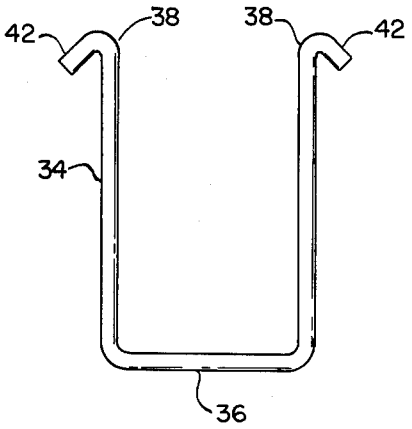
FIG. 6 is an elevation view of the adapter unit holding bracket.
Figure 7:
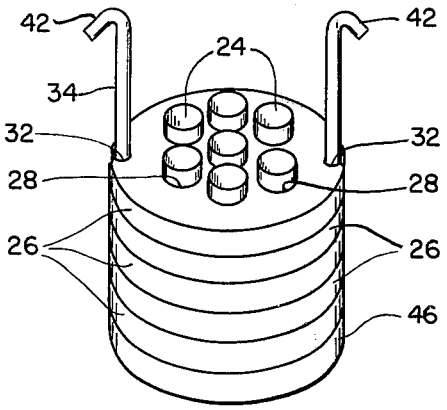
FIG. 7 is a perspective view of a series of adapter sections secured as a unit within the holding bracket.

The slots 32 within each of the adapter sections 26 are designed to receive the retaining bracket 34 shown in FIG. 6 which holds a variable number of the adapter sections according to the depth of the test tubes to be inserted within the rotor bucket. It should be noted that in each of the adapter sections 26 the recessed slots 32 are positioned in the same orientation with respect to the test tube cavities 28, so that, when a series of the adapter sections are stacked within the holding bracket 34 as shown in FIG. 7, the test tube cavities 28 will be in alignment with each other to provide a test tube cavity of sufficient depth and uniform diameter as required by the size of the particular test tube 24. Therefore, the holding bracket 34 not only retains the proper alignment between the respective cavities 28 in each of the adapter sections, but also holds the stacked series of adapter sections as a single unit.

The holding bracker 34 has a generally U-shaped configuration and is of sufficient length between its lower portion 36 and its upper open ends 38 to extend the entire depth of the bucket cavity 22 and over the upper edge 40 of the bucket 18. Located adjacent each of the upper ends 38 of the bracket are hook portions 42 which mate over the top slanted surface 44 of the bucket. Preferably the upper ends 38 of the holding bracket 34 with the flanges 42 extend above the upper edge 40 of the bucket. Therefore, as shown in FIG. 2, when the group of test tubes 24 as well as the adapter unit is significantly shorter than the depth of the bucket cavity 22, the holding bracket 34 allows for the easy placement and removal of the test tubes as a unit from within the rotor bucket. This is accomplished simply by holding the flanged portions 42 of the holding bracket 34 and lifting or inserting the adapter unit of adapter section 26 with respect to the bucket cavity 22.

Figure 5:
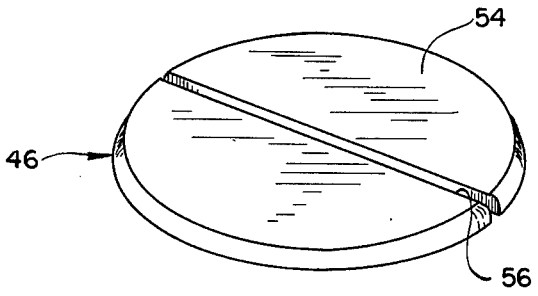
FIG. 5 is a perspective view of the bottom cushion pad.
Figure 10:
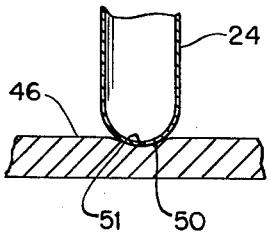
FIG. 10 is a sectional view of the interface between the bottom of the test tube and the resilient cushion pads in the bottom of the bucket.

As shown in FIGS. 2 and 5, a resilient cushion pad 46 is positioned within the bottom 48 of the bucket cavity 22. This support pad is made of a material which is sufficiently resilient to receive the bottoms or bottom configurations 50 of the test tubes 24. During centrifugation, the test tubes will form a nest of a somewhat conforming recess 51 in the pad 46 as shown in FIG. 10 which provides support over a larger area of the bottom 50 of each test tube in response to the high load created during centrifugation. Therefore, the typical problem of single point contact between the test tube 24 and a substantially rigid surface is eliminated. Consequently, higher r.p.m.'s with increased loads can be withstood by the test tube having an increased support surface formed by the resilient cushion pad 46 in response to the centrifugation loads on the test tube. In FIG. 5, the circular cushion pad 46 is shown with its bottom surface 54 having a diametrical slot 56 formed therein to receive the lower portion 36 of the holding bracket 34 (as shown in FIG. 2).

Figure 8:
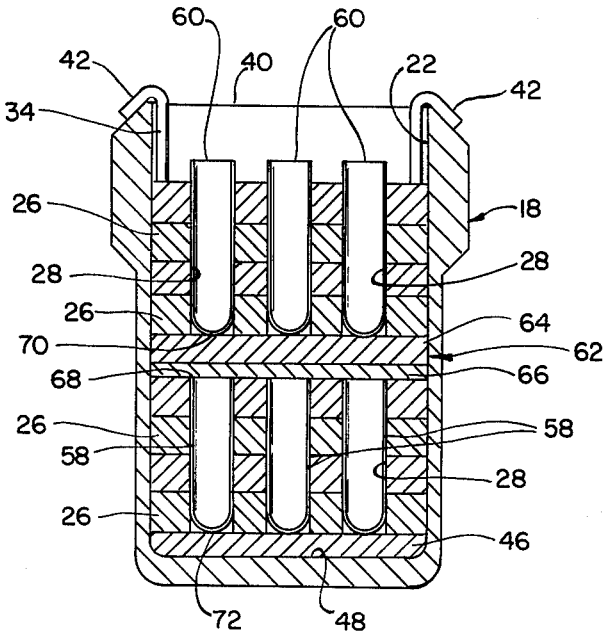
FIG. 8 is a sectional view of the rotor bucket having two separate compartments containing two sets of test tubes.
Figure 9:
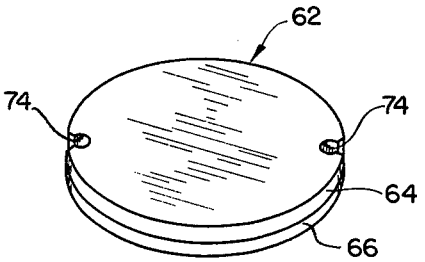
FIG. 9 is a perspective view of a divider plate.

In some instances the rotor cavity 22 in FIG. 2 has a depth that is twice the depth of the test tubes to be used. Therefore, it is desirable during the single centrifugation operation to incorporate as many of the test tube samples as possible. In FIG. 8, the rotor cavity 22 can be separated into two compartments with one series of test tubes 58 located near the bottom 48 of the bucket cavity and a second series of test tubes 60 located adjacent the upper edge 40 of the bucket. A divider plate 62 shown in FIG. 9 is used to partition the rotor cavity into the two sections. The divider plate 62 is constructed with an upper face or portion 62 made of the same resilient cushioning material used in the base pad 46 in FIG. 5. The lower face 66 is constructed of a rigid material which is used, as shown in FIG. 8, to cover the upper edges 68 of the lower series of test tubes 58. The bottoms 70 of the upper series of test tubes 60 are cushioned by the resilient material on the upper portion 64 of the divider 62. Similarly, the bottom 72 of each of the lower series of test tubes 58 is cushioned by the base cushion 46. It should be noted that the divider plate 62 has similarly configured recessed slots 74 as the recessed slots 32 in the adapter sections 26 in FIG. 3 to receive the holding bracket 34. Depending upon the depth of the bucket cavity 22 and the size of the test tubes, it is possible to establish several different compartments for layered series of test tubes within the rotor bucket.

As a result of the utilization of a series of relatively thin interface members or adapter sections 26, it is possible to construct the adapter sections with the test tube cavities 28 by injection molding. Therefore, the accumulate draft angle within the cavities 28 for a stacked group of adapter sections is limited to the accumulated draft angle of one adapter section 26. The accumulation of the draft angle will never exceed throughout the depth of the rotor bucket the draft angle accumulation found in any one separate adapter 26. The draft angle essentially results from the diameter of the tube cavity 28 adjacent one face 76 of the adapter section 26 being slightly larger than the diameter of the tube cavity adjacent the opposite face 78 of the adapter section 26. This angle is necessary to retract the core pins from the adapter after the injection molding process has been completed. This small accumulation of the draft angle through the thickness of one adapter section is acceptable to provide close tolerance support of the test tubes.

It should be noted that the adapter sections 26 can be made with varying numbers of test tube apertures 28 with different size diameters. However, adapter sections with the same number and sized holes must always be used in conjunction with each other for the same test tube to form the contiguous uniform test tube cavities throughout the stacked unit of adapter sections.

What is claimed is:

1. An adapter assembly for use within a centrifuge rotor to convert a single cell receptacle within said rotor to a multi-cell receptacle for receipt of a plurality of sample carrying holders, said assembly comprising a plurality of adapter sections positioned adjacent to each other in a stacked relation within said single cell receptacle, each of said adapter sections having at least two holes for alignment with similar holes in adjacent adapter sections to form said multi-cell receptacle, said plurality of adapter sections being variable in number to provide adjustment to the desired depth of said adapter assembly within said rotor to establish substantially the same depth in said adapter assembly as the depth of any of a number of various sized sample carrying holders.

2. An adapter assembly as defined in claim 1, wherein each of said adapter sections comprises a generally cylindrical member having a diameter at twice as large as its thickness.

3. An adapter assembly as defined in claim 1 and additionally comprising means for holding said plurality of adapter sections together as a single unit to maintain the alignment of said holes among said adapter sections.

4. An adapter assembly as defined in claim 1 and additionally comprising a resilient support pad located in the bottom of said single cell receptacle in said rotor to cushion said holders during centrifugation of said rotor, said support pad having an outer perimeter substantially the same as said adapter section, said support pad providing a support surface in substantial conformity to the bottom configuration of said holders during said centrifugation of said rotor to distribute the load exerted on said holders during said centrifugation throughout said bottom configuration of said holders.

5. An adapter assembly as defined in claim 1 and additionally comprising a divider plate having an outer perimeter substantially equal to the outer perimeter of each of said adapter sections, said divider plate establishing two separated portions within said single cell receptacles, each of said portions containing a plurality of said adapter sections to provide two multicell receptacles for receipt of two sets of said holders, one of said sets of holders being positioned over said other set.

6. An adapter assembly as defined in claim 5 wherein said divider plate has one face comprising a resilient material and the other face comprising a rigid material laminated to said resilient material.

7. An adapter assembly for use with a centrifuge rotor for allowing a single pocket within said rotor to receive and support a series of sample holding receptacles, said assembly comprising:

a plurality of similarly configured adapter sections positioned adjacent each other in stacked relation within said rotor pocket, each of said adapter sections having a plurality of cavities to receive said sample holding receptacles; and means within said pocket for holding said adapter sections together as a unit to maintain the alignment of said plurality of cavities among said adapter sections, said holding means extending to the open end of said pocket to facilitate the removal of said sections as a unit from said rotor pocket.

8. An adapter assembly as defined in claim 7 wherein said holding means comprises a spring biased U-shaped bracket, the width of said bracket being substantially the same as the width of said pocket, the height of said bracket being slightly greater than the depth of said pocket.

9. An adapter assembly as defined in claim 8 wherein each of said adapter sections has a pair of notches for receipt of said bracket.

10. A centrifuge rotor comprising:

a bucket mounted on said rotor;

a plurality of sample receiving receptacles positioned within said bucket;

means for supporting said receptacles in an aligned and spaced relation to each other within said bucket, said supporting means beig adjustable to accommodate the depth of said sample receiving receptacles; and means for dividing said bucket into at least two sections, each of said sections receiving a portion of said plurality of sample receiving receptacles.

11. A centrifuge rotor as defined in claim 10 wherein said dividing means comprises a divider plate having a rigid face and a resilient support.

12. An adapter assembly for use in the sample receiving pocket of a centrifuge rotor for receiving a plurality of receptacle units, said assembly comprising a plurality of similarly configured injection molded adapter sections positioned adjacent each other within said pocket, said adapter sections having a plurality of apertures for receipt of said plurality of receptacles, each of said adapter sections having a width at least four times as large as its thickness so that said injection molding accumulative draft angle of each of said apertures for the depth of said rotor pocket will not exceed the accumulative draft angle for said thickness of any one adapter section.

13. An adapter assembly for use within a centrifuge rotor to convert a single cell receptacle within said rotor to a multicell receptacle for receipt of a plurality of sample carry holders, said assembly comprising:

an adapter having a series of cavities extending completely through said adapter from one face of said adapter to another face of said adapter; and a resilient support pad located in the bottom of said single cell receptacle in said rotor to cushion said holders during centrifugation of said rotor, said support pad having an outer perimeter substantially the same as said adapter, said support pad providing a support surface in substantial conformity to the bottom configuration of said holders during said centrifugation of said rotor to distribute the load exerted on said holders during said centrifugation throughout said bottom configuration of said holders.

14. An adapter assembly for use with a centrifuge rotor to convert a single cell receptacle within said rotor to a multicell receptacle for receipt of a plurality of sample carrying holders, said assembly comprising:

at least two adapter sections having a series of cavities extending completely through each of said adapter sections; and a divider plate having an outer perimeter substantially equal to the outer perimeter of each of said adapter sections, said divider plate establishing two separated portions within said single cell receptacle, one of said portions containing one of said adapter sections and the other of said portions containing the other of said adapter sections to provide two multicell receptacles for receipt of two sets of said holders, one of said sets of holders being positioned over said other set.

* * * * *

UNITED STATES PATENT OFFICE

CERTIFICATE OF CORRECTION

Patent No. 4,032,066 Dated June 28, 1977

Inventor(s) Herschel E. Wright

It is certified that error appears in the above-identified patent and that said Letters Patent are hereby corrected as shown below:

| | |
|---|---|
| Column 5, line 60, | after "at" the word --least-- should be inserted. |
| Column 6, line 54, | "beig" should be deleted and the word --being-- should be inserted. |

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*